US011845269B2

(12) United States Patent
Ohara

(10) Patent No.: US 11,845,269 B2
(45) Date of Patent: Dec. 19, 2023

(54) PRINTING APPARATUS AND PRINTING METHOD

(71) Applicant: SEIKO EPSON CORPORATION, Tokyo (JP)

(72) Inventor: Eiichi Ohara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 18 days.

(21) Appl. No.: 17/359,804

(22) Filed: Jun. 28, 2021

(65) Prior Publication Data

US 2021/0402758 A1 Dec. 30, 2021

(30) Foreign Application Priority Data

Jun. 30, 2020 (JP) ..... 2020-112567

(51) Int. Cl.
*B41J 29/393* (2006.01)
*B41J 2/045* (2006.01)

(52) U.S. Cl.
CPC ..... *B41J 2/0451* (2013.01); *B41J 2/04586* (2013.01); *B41J 2/04588* (2013.01); *B41J 29/393* (2013.01)

(58) Field of Classification Search
CPC ..... B41J 2/04548; B41J 2/2135; B41J 29/393
See application file for complete search history.

(56) References Cited

U.S. PATENT DOCUMENTS 7,385,730 B2 * 6/2008 Ogasahara ..... G06K 15/102 358/3.1
2006/0087528 A1 * 4/2006 Rodenas ..... B41J 29/393 347/19
2007/0040878 A1 2/2007 Ikefuji et al.
2009/0021543 A1 * 1/2009 Baba ..... B41J 2/2135 347/9
2016/0059601 A1 * 3/2016 Arimori ..... B41J 2/04548 347/19

FOREIGN PATENT DOCUMENTS

JP 2007-054970 A 3/2007
JP 2016-221835 A 12/2016

* cited by examiner

*Primary Examiner* — Lam S Nguyen
(74) *Attorney, Agent, or Firm* — Global IP Counselors, LLP

(57) ABSTRACT

A printing apparatus includes a printing head including a first nozzle configured to discharge a first ink and a second nozzle configured to discharge a second ink having a higher brightness than the first ink, and a control unit configured to control the printing head to print, on a printing medium, a test pattern for inspecting a state of ink discharge by the first nozzle and the second nozzle. The test pattern includes a first pattern element formed by a plurality of dots of the first ink and a second pattern element formed by a plurality of dots of the second ink. The control unit causes the printing head to print the test pattern where a number of the dots of the second ink forming the second pattern element is greater than a number of the dots of the first ink forming the first pattern element.

6 Claims, 7 Drawing Sheets

50

| INK COLOR | NUMBER OF PASSES | THINNING RATIO |
|---|---|---|
| K | 2 | 50% |
| C | 2 | 50% |
| M | 2 | 50% |
| Y | 2 | 50% |
| LC | 4 | 0% |
| LM | 4 | 0% |

FIG. 7

PRINTING APPARATUS AND PRINTING METHOD

The present application is based on, and claims priority from JP Application Serial Number 2020-112567, filed Jun. 30, 2020, the disclosure of which is hereby incorporated by reference herein in its entirety.

BACKGROUND

1. Technical Field

The present disclosure relates to a printing apparatus and a printing method.

2. Related Art

Technology has been disclosed of an inkjet type printing apparatus in which a test pattern is printed on a print sheet by a recording head, the test pattern is read by a scanner, interpolation processing is performed on read data, and a nozzle abnormality is determined on the basis of the interpolated read data (see JP-A-2007-54970).

However, when a test pattern is printed on a printing medium using a head configured to discharge inks of a plurality of colors, in the test pattern, a difference in brightness may be small between the printing medium and a portion printed using some of the inks having a high brightness, among the plurality of colors of the inks. As a result, part of an inspection based on reading of the test pattern required to inspect the nozzles, and on reading data, may not be able to be appropriately performed. Thus, there is a need for a suitable test pattern for appropriately performing the reading, and the inspection after the reading.

SUMMARY

A printing apparatus includes a printing head including a first nozzle configured to discharge a first ink and a second nozzle configured to discharge a second ink having a higher brightness than the first ink, and a control unit configured to control the printing head to print, on a printing medium, a test pattern for inspecting a state of ink discharge by the first nozzle and the second nozzle. The test pattern includes a first pattern element formed by a plurality of dots of the first ink and a second pattern element formed by a plurality of dots of the second ink. The control unit causes the printing head to print the test pattern where a number of the dots of the second ink forming the second pattern element is greater than a number of the dots of the first ink forming the first pattern element.

A printing method includes a printing step of printing a test pattern on a printing medium, using a printing head including a first nozzle configured to discharge a first ink and a second nozzle configured to discharge a second ink having a higher brightness than the first ink, the test pattern being used to inspect a state of ink discharge by the first nozzle and the second nozzle. The test pattern includes a first pattern element formed by a plurality of dots of the first ink and a second pattern element formed by a plurality of dots of the second ink. The printing step causes the printing head to print the test pattern where a number of the dots of the second ink forming the second pattern element is greater than a number of the dots of the first ink forming the first pattern element.

BRIEF DESCRIPTION OF THE DRAWINGS

FIG. 7 is a diagram illustrating an example of a color-specific dot count table.

DESCRIPTION OF EXEMPLARY EMBODIMENTS

Embodiments of the present disclosure will be described below with reference to the accompanying drawings. Note that each of the drawings is merely illustrative for describing the embodiment. Since the drawings are illustrative, proportions and shapes may not be precise, match each other, or some may be omitted.

1. Apparatus Configuration

Figure 1:
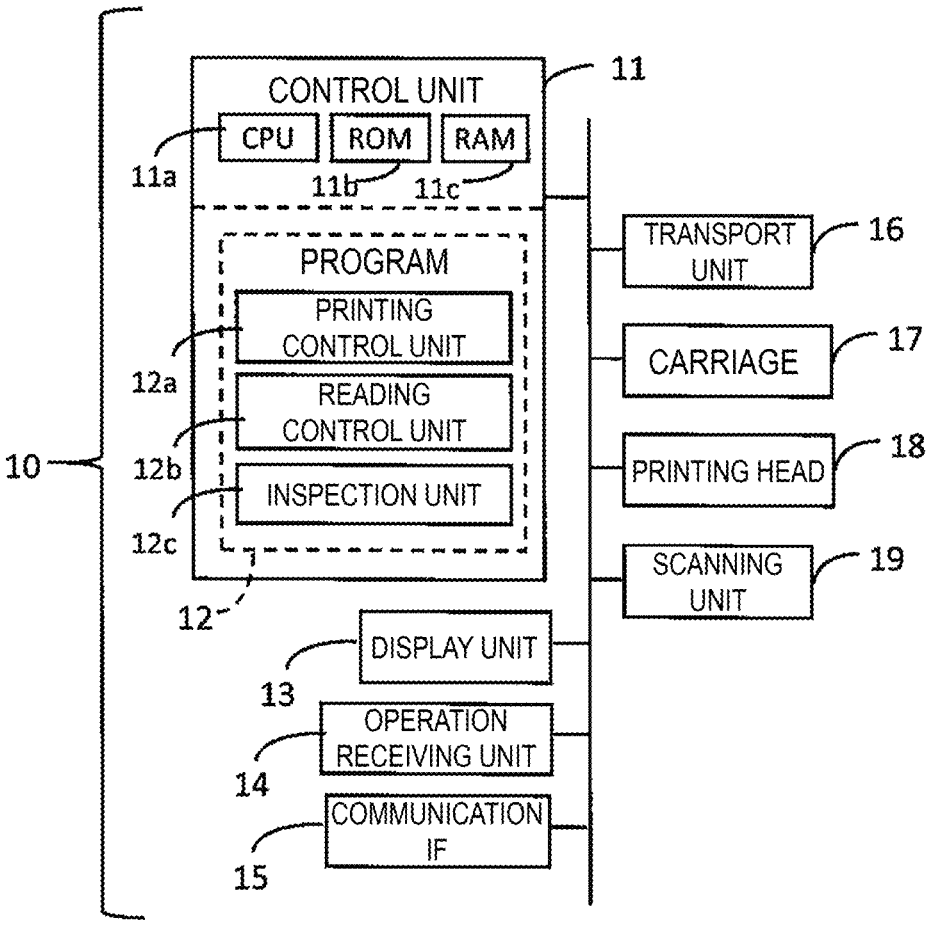
FIG. 1 is a block diagram illustrating a device configuration in a simplified manner.

FIG. 1 illustrates a configuration of a printing apparatus 10 according to the embodiment, in a simplified manner.

The printing apparatus 10 is provided with a control unit 11, a display unit 13, an operation receiving unit 14, a communication IF 15, a transport unit 16, a carriage 17, a printing head 18, a reading unit 19, and the like. IF is an abbreviation for interface. The control unit 11 is configured to include, as a processor, one or more ICs including a CPU 11*a*, a ROM 11*b*, a RAM 11*c*, and the like, another non-volatile memory, and the like.

In the control unit 11, the processor, that is, the CPU 11*a* executes arithmetic processing in accordance with one or more programs 12 stored in the ROM 11*b* the other memory, or the like, using the RAM 11*c* or the like as a work area, to realize various functions such as a printing control unit 12*a*, a reading control unit 12*b*, an inspection unit 12*c*, and the like. Note that the processor is not limited to the single CPU, and a configuration may be adopted in which the processing is performed by a hardware circuit such as a plurality of CPUs, an ASIC, or the like, or a configuration may be adopted in which the CPU and the hardware circuit work in concert to perform the processing.

The display unit 13 is a device for displaying visual information, and is configured, for example, by a liquid crystal display, an organic EL display, or the like. The display unit 13 may be configured to include a display and a drive circuit for driving the display. The operation receiving unit 14 is a device for receiving an operation by a user, and is realized, for example, by a physical button, a touch panel, a mouse, a keyboard, or the like. Of course, the touch panel may be realized as a function of the display unit 13.

The display unit 13 and the operation receiving unit 14 may be part of the configuration of the printing apparatus 10, or may be peripheral devices externally coupled to the printing apparatus 10. The communication IF 15 is a generic term for one or a plurality of IFs for coupling the printing apparatus 10 with the outside in a wired or wireless manner, in accordance with a prescribed communication protocol including a known communication standard provide.

The transport unit 16 is a device for transporting the printing medium, and includes a roller, a motor for rotating the roller, and the like. The printing head 18 ejects ink from nozzles onto the printing medium, using an inkjet method, to perform printing. The reading unit 19 is a device for reading a printing result on the printing medium. The reading unit 19 is also referred to as a scanner. However, the printing apparatus 10 may have a configuration that does not include the reading unit 19.

Figure 2:
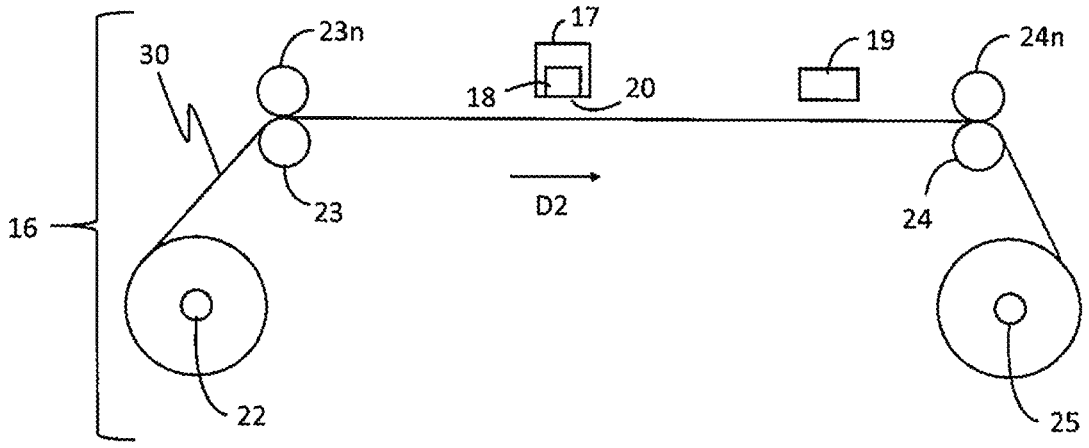
FIG. 2 is a diagram illustrating a specific example of a configuration including a transport unit and a printing head.
Figure 3:
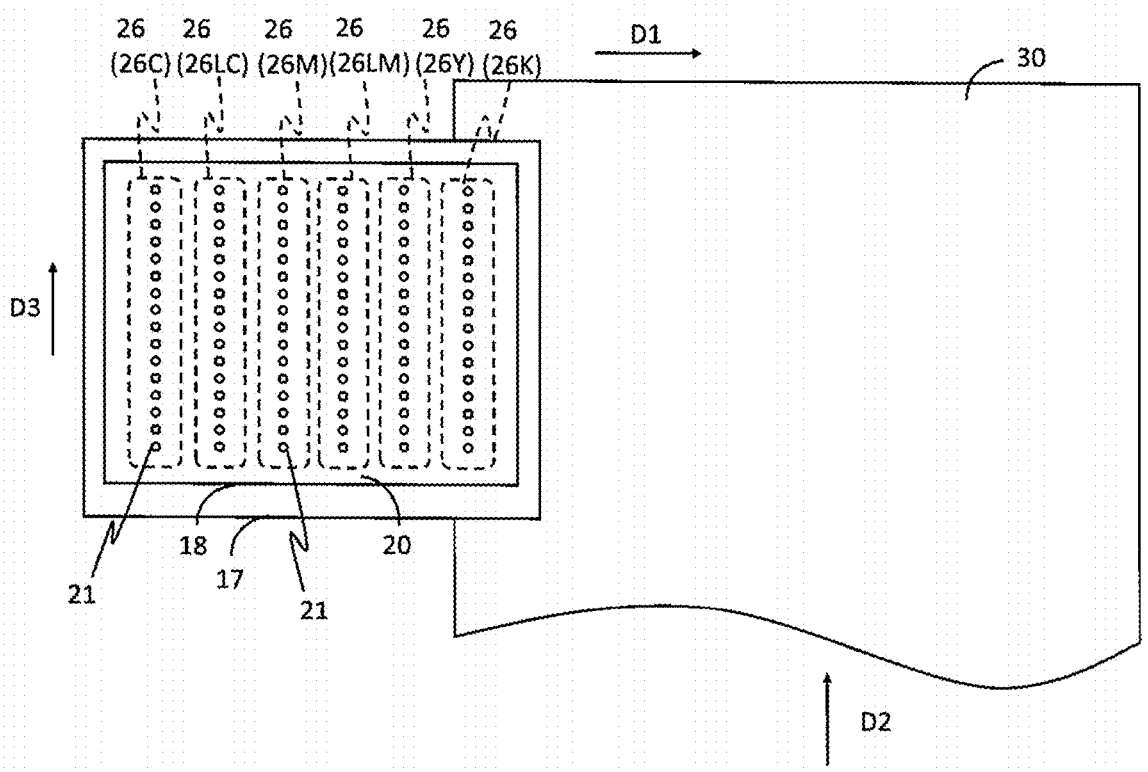
FIG. 3 is a view illustrating a relationship between the printing medium and the printing head, as seen from above.

The carriage 17 is a mechanism capable of reciprocating along a predetermined direction as a result of receiving power from a carriage motor (not illustrated). The predetermined direction in which the carriage 17 moves is referred to as a main scanning direction. As illustrated in FIG. 2 and FIG. 3, the printing head 18 is mounted on the carriage 17.

The configuration of the printing apparatus 10 illustrated in FIG. 1 may be realized by a single printer, or may be realized by a plurality of communicatively coupled devices.

In other words, the printing apparatus 10 may be the printing system 10 in actuality. The printing system 10 includes, for example, an information processing device that functions as the control unit 11, and a printer including the transport unit 16, the carriage 17, the printing head 18, and further, the reading unit 19. A printing method according to the embodiment is realized in this way by the printing apparatus 10 or the printing system 10.

Further, a portion of the control unit 11 that functions as the printing control unit 12*a* and a portion of the control unit 11 that functions as the reading control unit 12*b* and the inspection unit 12*c* may be separate information processing devices.

FIG. 2 illustrates a specific example of a configuration mainly including the transport unit 16 and the printing head 18, which are part of the printing apparatus 10. In FIG. 2, the specific example is illustrated using a perspective orthogonal to a transport direction D2 of a printing medium 30.

The transport unit 16 is provided with a feeding shaft 22 upstream in the transport direction, and a winding shaft 25 downstream in the transport direction. Upstream and downstream in the transport direction are simply denoted using upstream and downstream. The long printing medium 30 wound in a roll shape around the feeding shaft 22 and the winding shaft 25 is stretched along the transport direction D2. The printing medium 30 is transported in the transport direction D2. The printing medium 30 may be a paper sheet or may be a medium made from a material other than paper.

In the example illustrated in FIG. 2, the printing medium 30 wound around the feeding shaft 22 is fed downstream by the feeding shaft 22 rotating in the clockwise direction. A front driving roller 23 is provided at a position downstream of the feeding shaft 22, and a rear driving roller 24 is provided at a position upstream of the winding shaft 25. By rotating in the clockwise direction, the front driving roller 23 transports downstream the printing medium 30 fed out from the feeding unit 22. A nip roller 23*n* is provided with respect to the front driving roller 23. The nip roller 23*n* comes into contact with the printing medium 30 so as to clamp the printing medium 30 between the nip roller 23*n* and the front driving roller 23.

By rotating in the clockwise direction, the rear driving roller 24 transports further downstream the printing medium 30 transported downstream by the front driving roller 23. Note that a nip roller 24*n* is provided with respect to the rear driving roller 24. The nip roller 24*n* comes into contact with the printing medium 30 so as to clamp the printing medium 30 between the nip roller 24*n* and the rear driving roller 24.

The printing head 18 that discharges ink onto the printing medium 30 from above is disposed between the front driving roller 23 and the rear driving roller 24. As illustrated in FIG. 2, the printing head 18 is mounted on the carriage 17. The printing head 18 is capable of discharging a plurality of colors of ink, such as cyan (C), magenta (M), yellow (Y), black (K), light cyan (LC), and light magenta (LM), for example.

Each of the nozzles of the printing head 18 is open in a nozzle surface 20, of the printing head 18, facing the printing medium 30, and the printing head 18 discharges or does not discharge the ink from the nozzles on the basis of print data. The ink discharged by the nozzle is also referred to as an ink droplet, or as a dot. The printing head 18 may also be referred to as a print head, an inkjet head, a liquid discharging head, a recording head, and the like.

As a result of the winding shaft 25 rotating in the clockwise direction, the winding shaft 25 takes up the printing medium 30 after printing that is transported by the rear driving roller 24.

The feeding shaft 22, the winding shaft 25, each of the rollers, the motor (not illustrated) for rotating these members as appropriate, and the like are a specific example of the transport unit 16 that transports the printing medium 30. A number and arrangement of the rollers provided along the transport path for transporting the printing medium 30 is not limited to the mode illustrated in FIG. 2. Further, the colors of the inks discharged by the printing head 18 are not limited to the colors described above. It goes without saying that a flat platen or the like, which supports, from below, the printing medium 30 that receives the ink discharge from the printing head 18, may be provided between the front driving roller 23 and the rear driving roller 24. Further, the portion of the printing medium 30 on which the printing by the printing head 18 has been performed need not necessarily be wound into the roll shape by the winding shaft 25, and may be cut away from the printing medium 30 that is upstream of the printed portion, using a cutter (not illustrated).

In the example illustrated in FIG. 2, the reading unit 19 is provided at a position downstream of the carriage 17 and the printing head 18 and upstream of the rear driving roller 24. Using an image sensor, the reading unit 19 optically reads the printing medium 30 on which the printing has been performed by the printing head 18, and outputs image data as a reading result. The reading unit 19 may be configured to read the printing medium 30 while being moved by the carriage in a similar manner to the printing head 18, or may be configured to read the printing medium 30 in a stationary state.

FIG. 3 illustrates a relationship between the printing medium 30 and the printing head 18 in a simplified manner, as seen from above. The printing head 18 mounted on the carriage 17 moves, together with the carriage 17, from one end of a main scanning direction D1 to the other end (a forward movement) and from the other end to the one end (a return movement). The main scanning direction D1 and the transport direction D2 intersect each other. The intersection may be understood to be orthogonal. Accordingly, FIG. 2 illustrates the printing head 18 and the like from a perspective facing in the main scanning direction D1. However, due to various errors in the printer as a manufactured product, for example, the main scanning direction D1 and the transport direction D2 may not be precisely orthogonal.

In FIG. 3, an example is illustrated of an array of nozzles 21 in the nozzle surface 20. Each of small circles in the nozzle surface 20 is the nozzle 21. The printing head 18 is provided with a plurality of nozzle rows 26 in a configuration in which each color of the inks is discharged from the nozzles 21 after being supplied from a liquid holding unit (not illustrated) that is referred to as an ink cartridge, an ink tank, or the like. The nozzle row 26 including the nozzles 21 that discharge the C ink is also described as a nozzle row 26C. Similarly, the nozzle row 26 including the nozzles 21 that discharge the M ink is also described as a nozzle row 26M, the nozzle row 26 including the nozzles 21 that discharge the Y ink is also described as a nozzle row 26Y, the nozzle row 26 including the nozzles 21 that discharge the K ink is also described as a nozzle row 26K, the nozzle row 26 including the nozzles 21 that discharge the LC ink is also described as a nozzle row 26LC, and the nozzle row 26 including the nozzles 21 that discharge the LM ink is also described as a nozzle row 26LM. The nozzle rows 26C, 26M, 26Y, 26K, 26LC, and 26LM are aligned along the main scanning direction D1.

Each of the nozzle rows 26 is configured by the plurality of nozzles 21 for which a nozzle pitch, which is an interval between the nozzles 21 in the transport direction D2, is constant or substantially constant. The direction in which the plurality of nozzles 21 configuring the nozzle row 26 are aligned is referred to as a nozzle row direction D3. In the example illustrated in FIG. 3, the nozzle row direction D3 is parallel with the transport direction D2. In the configuration in which the nozzle row direction D3 is parallel with the transport direction D2, the nozzle row direction D3 and the main scanning direction D1 are orthogonal. However, the nozzle row direction D3 need not necessarily be parallel with the transport direction D2, and a configuration may be adopted in which the nozzle row direction D3 obliquely intersects the main scanning direction D1.

The respective positions of the nozzle rows 26C, 26M, 26Y, 26K, 26LC, and 26LM in the transport direction D2 match each other. The printing apparatus 10 prints an image on the printing medium 30 by performing a combination of transport of the printing medium 30 in the transport direction D2, and ink discharge by the printing head 18 in accordance with movement of the carriage 17 along the main scanning direction D1. The operation of the ink discharge by the printing head 18 in accordance with the forward movement and the return movement of the carriage 17 is referred to as a "scan" or a "pass". The movement of the printing head 18 in the main scanning direction D1 by the carriage 17 corresponds to one of relative movements between the printing head 18 and the printing medium 30.

2. Test Pattern Printing

Figure 4:
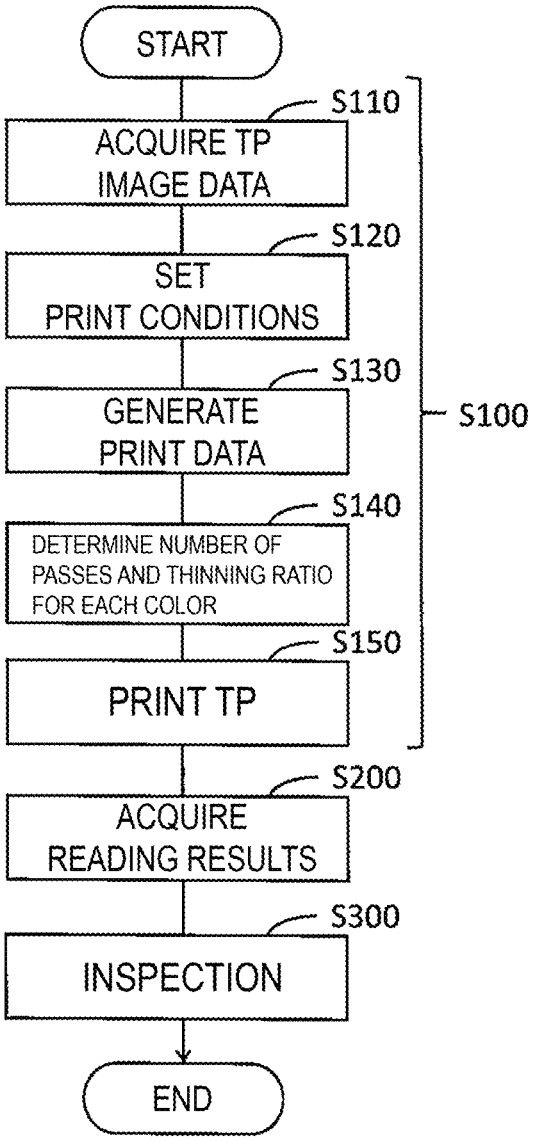
FIG. 4 is a flowchart illustrating a flow from TP printing to an inspection of nozzles.

FIG. 4 illustrates, using a flowchart, a flow executed by the control unit 11 in accordance with the program 12, from printing of a TP to an inspection of the nozzles 21 on the basis of the TP. TP is an abbreviation for test pattern. The flowchart consists, in overview, of TP printing processing (step S100), acquisition of a reading result of the printed TP (step S200), and an inspection based on the reading result of the TP (step S300). Step S100 corresponds to a TP printing step. In FIG. 4, step S100 is illustrated in detail while being divided into steps S110 to S150.

At step S110, the printing control unit 12*a* acquires TP image data, which is image data representing the TP, from a storage source such as a predetermined memory or storage device with which the control unit 11 can communicate. The TP image data is, for example, image data in a bitmap format defining the color of each of pixels in a predetermined color system. As the color system referred to here, for example, there are various color systems, such as an RGB (red, green, blue) color system, a CMYK color system, or the like.

At step S120, the printing control unit 12*a* sets TP printing conditions. The printing control unit 12*a* sets the printing conditions when performing normal printing as the TP printing conditions. The normal printing refers to a process in which an object such as a photo, text, CG, or the like chosen by the user is printed, rather than the TP. The user can set the printing conditions for the normal printing by operating the operation receiving unit 14 while viewing a user interface (UI) screen displayed on the display unit 13. The printing conditions include, for example, the type of the printing medium 30 and a printing quality.

The print quality is presented to the user as subjective options, such as high resolution, normal, fast, and the like, and the printing control unit 12*a* sets each of items necessary for execution of the printing in accordance with the selected printing quality, such as a movement velocity of the carriage 17, a transport velocity of the transport unit 16, a waveform of drive signals used to drive the nozzles 21, and a driving period of the nozzles 21 in the pass. Further, if a default setting is provided for the printing conditions, and the user does not specifically change the default setting, the printing control unit 12*a* applies the default setting to the TP printing or the normal printing.

The order of execution of steps S110 and S120 may be reversed from that illustrated in FIG. 4, or may be substantially simultaneous.

At step S130, the printing control unit 12*a* generates the print data for the TP printing, from the TP image data. The printing control unit 12*a* generates the print data that prescribes ink discharge (dot on) or ink non-discharge (dot off) for each of the pixels and each of the ink colors, by performing predetermined image processing, such as color conversion processing and halftone processing, on the TP image data. As illustrated in FIG. 3, assuming that the printing head 18 uses the six colors of ink of CMYKLCLM, at step S130, the printing control unit 12*a* generates the print data prescribing the dot on and off for each of the pixels and for each of CMYKLCLM, based on the TP image data.

Figure 5:
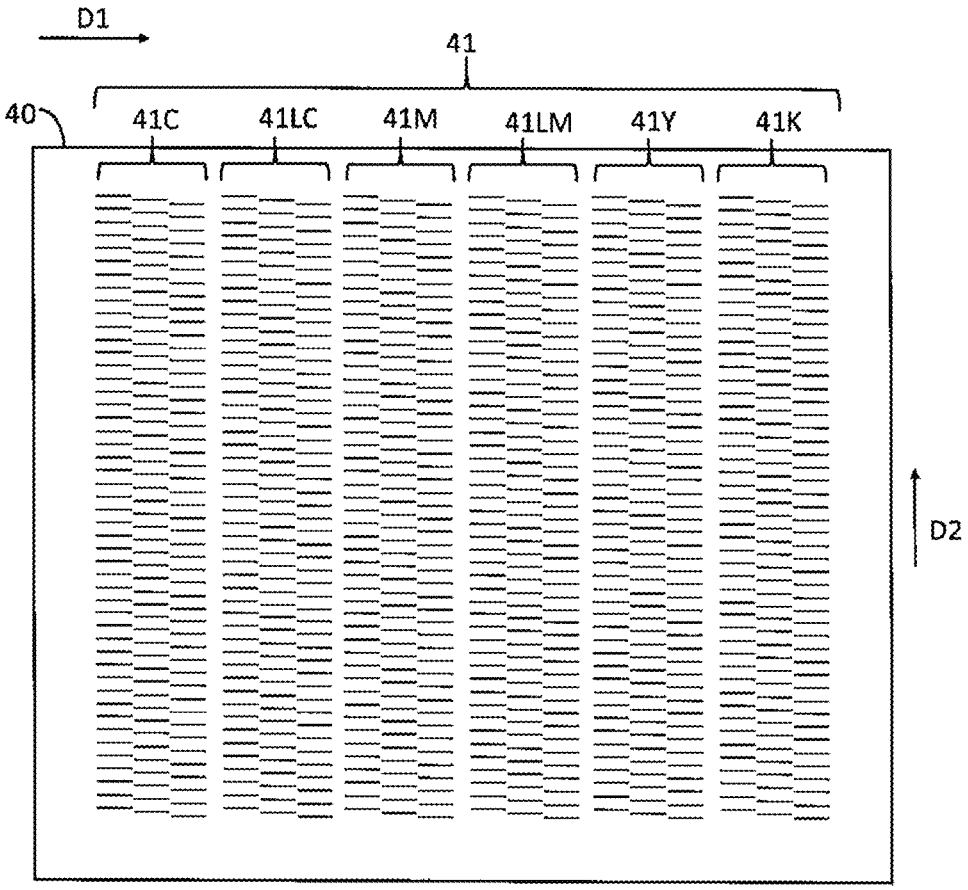
FIG. 5 is a diagram illustrating an example of TP image data.
Figure 6:
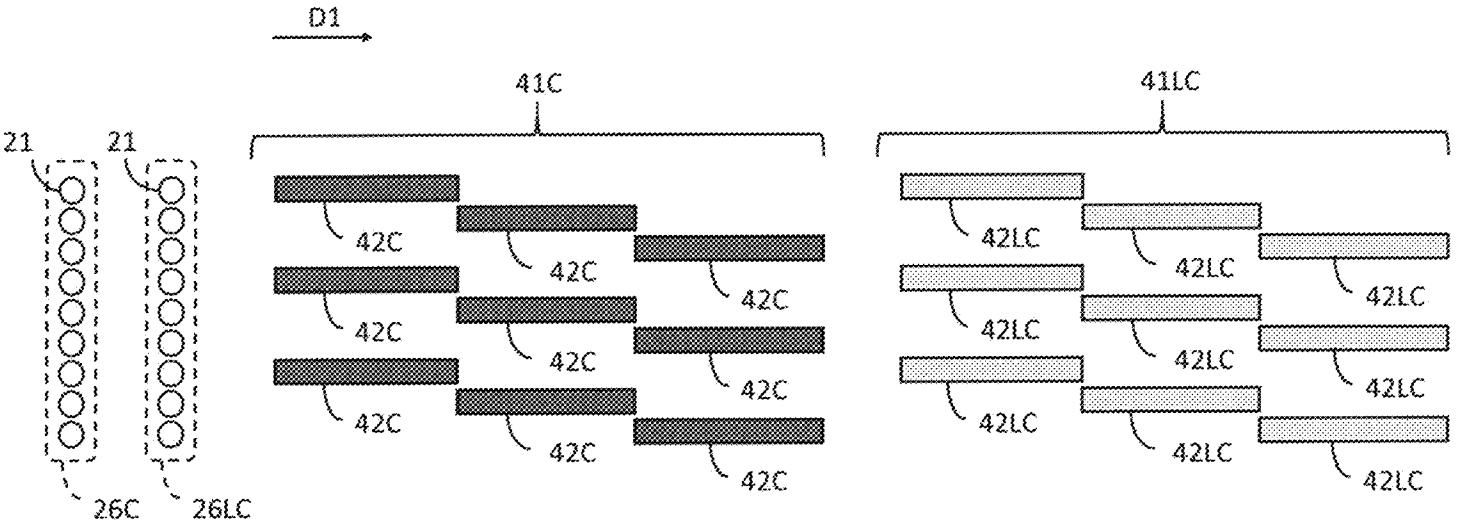
FIG. 6 is a diagram illustrating an enlarged portion of a TP.

FIG. 5 illustrates an example of TP image data 40 acquired at step S110. The TP image data 40 is image data representing a TP 41. In FIG. 5, and FIG. 6 to be described below, a correspondence relationship between the TP image data 40 and the directions D1 and D2 is also illustrated. The TP 41 includes a TP for each of the ink colors. According to FIG. 5, a TP 41C is the TP represented by the color C. Similarly, a TP 41LC is the TP of the LC color, a TP 41M is the TP of the M color, a TP 41LM is the TP of the LM color, a TP 41Y is the TP of the Y color, and a TP 41K is the TP of the K color.

In the TP image data 40, the TPs 41C, 41LC, 41M, 41LM, 41Y, and 41K for each of the ink colors are aligned in the main scanning direction D1, and the positions thereof in the transport direction D2 are the same as each other. Each of the TPs 41C, 41LC, 41M, 41LM, 41Y, and 41K for each of the ink colors is a collection of a plurality of "pattern elements". In the example illustrated in FIG. 5, each of the pattern elements is a ruled line parallel to the main scanning direction D1. Each one of the pattern elements is an image printed using one of the nozzles 21 of the corresponding ink color.

FIG. 6 illustrates an enlarged portion of the TP 41 represented by the TP image data 40. Specifically, FIG. 6 illustrates portions of the TP 41C and the TP 41LC, respectively. The TP 41C is configured by a plurality of pattern elements 42C arranged at equal intervals in the transport direction D2, and the TP 41LC is configured by a plurality of pattern elements 42LC arranged at equal intervals in the transport direction D2. In FIG. 6, for ease of understanding, as well as the TPs 41C and 41LC, a portion of each of the nozzle rows 26C and 26LC used for printing the TPs 41C and 41LC are also illustrated. In other words, each of the pattern elements 42C is disposed at a spacing similar to the nozzle pitch in the transport direction D2, such that each one of the pattern elements 42C configuring the TP 41C is printed by one of the nozzles 21 configuring the nozzle row 26C. Similarly, each of the pattern elements 42LC is arranged at a spacing similar to the nozzle pitch in the transport direction D2, such that each one of the pattern elements 42LC configuring the TP 41LC is printed by one of the nozzles 21 configuring the nozzle row 26LC.

Further, in the example illustrated in FIG. 6, in order to easily verify each one of these pattern elements 42C at the time of inspection, each of the pattern elements 42C is disposed with a position thereof being offset in the main scanning direction D1, such that the positions thereof in the main scanning direction D1 coincide every three cycles. Similarly, each of the pattern elements 42LC is also disposed with a position thereof being offset in the main scanning direction D1, such that the positions thereof in the main scanning direction D1 coincide every three cycles. However, the pattern elements configuring the TP corresponding to one of the ink colors may all have the same position in the main scanning direction D1.

Further, in the example illustrated in FIG. 6, the pattern elements 42C and the pattern elements 42LC are disposed with the positions thereof offset in the main scanning direction D1 in order to reduce the bleed-through of each one of the pattern elements 42C and the pattern elements 42LC. For example, when the pattern element 42C is printed in two passes, the dots printed in a first pass are disposed at odd-numbered pixel positions in the main scanning direction D1, and the dots printed in a second pass are disposed at even-numbered pixel positions in the main scanning direction D1. Further, for example, when the pattern element 42LC is printed in four passes, the dots printed in the first pass and the third pass are disposed at the odd-numbered pixel positions in the main scanning direction D1, and the dots printed in the second pass and the fourth pass are disposed at the even-numbered pixel positions in the main scanning direction D1. However, when printing on the printing medium 30 in which bleed-through is not likely to occur, the dots may be formed in all of the pixels in each pass.

The print data generated at step S130 is image data in which the TP 41 represented by the TP image data 40 is expressed using the dot on and off. Each of the pattern elements configuring each of the TPs 41C, 41LC, 41M, 41LM, 41Y, and 41K for each of the ink colors is formed of dots of the corresponding ink color only.

At step S140, the printing control unit 12*a* determines a number of passes and a thinning ratio when printing the TP, for each of the ink colors. As illustrated in FIG. 5, since the TP 41 is configured by the TPs 41C, 41LC, 41M, 41LM, 41Y, and 41K for each of the ink colors, the printing control unit 12*a* determines the number of passes and the thinning ratio for each of the TPs 41C, 41LC, 41M, 41LM, 41Y, and 41K.

In the embodiment, the processing at step S140 is performed by categorizing the plurality of inks into a "first ink" and a "second ink" that is brighter than the first ink. In other words, the second ink has a higher brightness than the first ink. Specifically, the CMYK inks are the first inks and the LCLM inks are the second inks. The LC ink and the LM ink are generally referred to as light inks. Further, the nozzle 21 that discharges the first ink is referred to as a "first nozzle", and the nozzle 21 that discharges the second ink is referred to as a "second nozzle". According to the categorization described above, each of the nozzles 21 configuring the nozzle rows 26C, 26M, 26Y, and 26K is the first nozzle, and each of the nozzles 21 configuring the nozzle rows 26LC and 26LM is the second nozzle.

Further, the pattern element formed by the plurality of dots of the first ink is referred to as a "first pattern element", and the pattern element formed by the plurality of dots of the second ink is referred to as a "second pattern element". Each of the pattern elements 42C configuring the TP 41C illustrated in FIG. 6 is an example of the first pattern element, and each of the pattern elements 42LC configuring the TP 41LC is an example of the second pattern element.

FIG. 7 illustrates an example of a color-specific dot count table 50. The color-specific dot number table 50 is stored in advance in a memory or a storage device, either in or outside the printing apparatus 10, so as to be accessible by the control unit 11. The color-specific dot count table 50 is a table defining parameters used to determine, directly or indirectly, the number of dots for printing the TP for each of the ink colors on the printing medium 30. According to FIG. 7, the color-specific dot count table 50 prescribes the number of passes and the thinning ratio for each of CMYKLCLM that are the ink colors. At step S140, the printing control unit 12*a* refers to the color-specific dot count table 50 to determine the number of passes and the thinning ratio for each of the ink colors.

The number of passes is the number of the passes used to print the TP. For example, if the number of passes is 2 for a given ink color, this does not mean that the TP represented by the print data generated at step S130 is printed in two passes, but that the pass to print the TP of the ink color represented by the print data is repeated twice. Thus, the greater the number of passes, the greater the number of dots forming the TP reproduced on the printing medium 30. According to the color dot number table 50, the print control unit 12*a* determines that the number of passes is 2 for the CMYK inks that are the first ink, and determines that the number of passes is 4 for the LCLM inks that are the second ink.

The thinning ratio is the thinning ratio in a single pass. For example, when the thinning ratio relating to the given ink color is 50%, in one pass, during a period for printing the TP of the ink color represented by the print data generated at step S130, regardless of whether the original dot is dot on or dot off, for 50% of the pixels, dot off is forcibly applied and the ink is not discharged. Therefore, the higher the thinning ratio, the fewer the number of dots forming the TP reproduced on the printing medium 30. Further, it can be said that the higher the thinning ratio, the more a discharge rate of the ink by the nozzle 21 is reduced, and the lower the thinning ratio, the more the discharge rate of the ink by the nozzle 21 is increased. Thus, by changing the thinning ratio for each of the ink colors, the discharge rate of the nozzles 21 can be controlled for each of the ink colors. According to the color-specific dot count table 50, the print control unit 12*a* determines that the thinning ratio is 50% for the CMYK inks that are the first ink, and determines that the thinning ratio is 0% for the LCLM inks that are the second ink. When the thinning ratio is 0%, this means that the printing is performed as per the print data for each of the passes.

Here, in the print data generated at step S130, it is assumed that all of the individual pattern elements that configure any of the TPs 41C, 41LC, 41M, 41LM, 41Y, and 41K for each of the ink colors is configured by approximately the same number of dots. According to step S140 at which the color-specific dot count table 50 is referred to, for the CMYK inks that are the first ink, the number of passes is determined to be 2 and the thinning ratio is determined to be 50%, and, for the LCLM inks that are the second ink, the number of passes is determined to be 4 and the thinning ratio is determined to be 0%. As a result, when comparing the number of dots between the pattern elements printed on the printing medium 30 based on the determination at step S140, the number of dots of one of the second pattern elements, such as the number of dots of the LC ink forming one of the pattern elements 42LC, for example, is approximately four times the number of dots of one of the first pattern elements, such as the number of dots of the C ink forming one of the pattern elements 42C, for example.

At step S150, the printing control unit 12*a* prints the TP 41 on the printing medium 30 by controlling the movement of the carriage 17 and the ink discharge by the printing head 18, in accordance with the printing conditions set at step S120, the print data generated at step S130, and the number of passes and the thinning ratio determined for each of the ink colors at step S140. Specifically, based on the color-specific dot count table 50, the printing head 18 performs four passes to print the TP 41 on the printing medium 30. Of all the four passes, in each of four of the passes, the printing head 18 discharges the LC ink and the LM ink from each of the nozzles 21 of the nozzle rows 26LC and 26LM, and prints the TPs 41LC and 41LM based on the print data and at the thinning ratio of 0%. Further, of all the four passes, in each of two of the passes, the printing head 18 discharges the CMYK inks from each of the nozzles 21 of the nozzle rows 26C, 26M, 26Y, and 26K, and prints the TPs 41C, 41M, 41Y, and 41K based on the print data and at the thinning ratio of 50%.

As a result, when performing a comparison at a pattern element level, the printing control unit 12*a* has printed the TP 41 such that the number of dots of the second ink forming the second pattern element is greater than the number of dots of the first ink forming the first pattern element. Note that the printing control unit 12*a* does not cause the transport unit 16 to transport the printing medium 30 during a period of time from a first pass for the printing head 18 to print the TP 41 to the end of a last pass.

The above is a description of step S100. Steps S200 and S300 will be briefly described.

At step S200, the reading control unit 12*b* controls the reading unit 19 to read the printing medium 30 on which the TP 41 has been printed at step S100, and retrieves the image data from the reading unit 19 as the reading result. It goes without saying that the transport unit 16 performs the transport necessary for the reading unit 19 to read the printing medium 30 after the printing.

However, at step S200, it is sufficient that the reading result of the printing medium 30 on which the TP 41 has been printed can be acquired. Thus, the user may cause an external scanner to read the printing medium 30 on which the TP 41 has been printed, and the printing apparatus 10 may acquire the reading result via the communication IF 15.

At step S300, the inspection unit 12*c* inspects a state of the ink discharge by the nozzles 21 of the printing head 18, based on the image data acquired as the reading result at step S200. The state of the ink discharge is divided into normal and abnormal. Abnormal applies to a discharge failure in which the dot cannot be discharged, landing position displacement in which the landing positions of the dots are displaced from ideal landing positions, and the like. The inspection unit 12*c* inspects whether each of the nozzles 21 is normal or abnormal by analyzing the image data and identifying a density and position of each of the pattern elements for each of the ink colors and for each of the nozzles 21, and stores inspection results as data.

The flowchart illustrated in FIG. 4 ends here.

3. Summary and Description of Effects

As described above, according to the embodiment, the printing apparatus 10 includes the printing head 18 including the first nozzles that discharge the first ink and the second nozzles that discharge the second ink having a higher brightness than the first ink, and the control unit 11 that, by controlling the printing head 18, causes the TP to be printed on the printing medium 30 for the inspection of the state of the ink discharge by the first nozzles and the second nozzles. The TP includes the "first ink pattern element" formed by the plurality of dots of the "first ink" and the "second ink pattern element" formed by the plurality of dots of the "second ink" having the higher brightness than the first ink. Then, the control unit 11 causes the printing head 18 to print the TP in which the number of dots of the second ink forming the second pattern element is higher than the number of dots of the first ink forming the first pattern element.

According to the configuration described above, the pattern element formed by the LC ink and the pattern element formed by the LM ink that are the second inks (the second pattern elements) are printed using more dots than the first pattern element formed by the first ink. As a result, the second pattern element can also be printed with a certain degree of density. As a result, even when a difference in brightness is small between the printing medium 30 and a portion, of the TP for inspecting each of the nozzles 21, printed using some of the inks having the high brightness, a failure resulting from not being able to appropriately perform the inspection based on the reading result of the reading can be eliminated. Specifically, for the pattern element having the small difference in brightness with the printing medium 30 that is white or of a color having a high brightness, it is difficult to accurately identify the position and the like of the pattern element at the time of the inspection based on the reading result. Thus, the determination relating to normal or abnormal as described above cannot be performed with a high degree of accuracy. However, using the TP printed at step S100 of the embodiment, the nozzle 21 for any of the ink colors can be inspected with a high degree of accuracy based on the pattern element.

Further, according to the embodiment, the printing head 18 is capable of performing the scan that discharges the first ink from the first nozzles and the second ink from the second nozzles as the printing head 18 moves in the predetermined direction, and the control unit 11 causes the printing head 18 to print the TP in which the number of scans for printing the second pattern element is greater than the number of scans for printing the first pattern element. In other words, the control unit 11 causes the printing head 18 to print the TP in which the number of scans for printing the second pattern element is greater than the number of scans for printing the first pattern element.

According to the configuration described above, by causing the number of scans for printing the second pattern element to be greater than the number of scans for printing the first pattern element, the control unit 11 can easily print the TP in which the number of dots of the second ink forming the second pattern element is greater than the number of dots of the first ink forming the first pattern element.

Further, according to the embodiment, the control unit 11 may cause the printing head 18 to print the TP in which a discharge rate of the second ink by the second nozzles for printing the second pattern element is higher than a discharge rate of the first ink by the first nozzles for printing the first pattern element. In other words, the control unit 11 causes the printing head 18 to print the TP in which the discharge rate of the second ink by the second nozzles for printing the second pattern element is higher than the discharge rate of the first ink by the first nozzles for printing the first pattern element.

According to the configuration described above, by causing the discharge rate of the second ink by the second nozzles for printing the second pattern element to be higher than the discharge rate of the first ink by the first nozzles for printing the first pattern element, the control unit 11 can easily print the TP in which the number of dots of the second ink forming the second pattern element is greater than the number of dots of the first ink forming the first pattern element.

The number of passes and numerical values of the thinning ratio for each of the ink colors in the color-specific dot number table 50 illustrated in FIG. 7 are merely examples. Further, the color-specific dot count table 50 may be, for example, a table in which the number of passes is the same regardless of the ink color, and the difference between the first ink and the second ink is provided in terms of the thinning ratio. Alternatively, the color-specific dot count table 50 may be a table in which the thinning ratio is the same regardless of the ink color, and the difference between the first ink and the second ink is provided in terms of the number of passes.

Further, according to the embodiment, the printing conditions when printing the TP are the same as the printing conditions when performing the normal printing.

In other words, the control unit 11 sets a velocity of a relative movement between the printing head 18 and the printing medium 30 when printing the TP to be the same as the velocity of the relative movement when performing the normal printing. According to the above description, the velocity of the relative movement referred to here is the movement velocity of the carriage 17 when performing the pass.

Further, the control unit 11 sets a waveform of a drive signal used to drive the first nozzles and the second nozzles when printing the TP to be the same as the waveform of the drive signal used to drive the first nozzles and the second nozzles when performing the normal printing. The drive signal used to drive the nozzle 21 is a pulse wave, and the drive signal is applied to a driving element of each of the nozzles 21 in accordance with the dot on information, thus causing the dot to be discharged from the nozzle 21. If the waveform of the drive signal is different, a size of the dot discharged by the nozzle 21 in a single drive is also different.

In this way, by setting the velocity of the relative movement and the drive signal to be the same for the printing of the TP and for the normal printing, the TP suitable for performing the inspection of the nozzle 21 can be printed under the same conditions as when performing the normal printing.

The embodiment also discloses an invention of each of categories, such as a method other than the printing apparatus 10 and the printing system 10, and the program 12.

The printing method includes the printing step of printing the TP, which is used to inspect the state of the ink discharge by the first nozzles and the second nozzles on the printing medium, using the printing head including the first nozzles that discharge the first ink and the second nozzles that discharge the second ink having the higher brightness than the first ink. The test pattern includes the first pattern element formed by the plurality of dots of the first ink and the second pattern element formed by the plurality of dots of the second ink, and the printing step causes the printing head to print the test pattern where the number of the dots of the second ink forming the second pattern element is greater than the number of the dots of the first ink forming the first pattern element.

4. Other Embodiments

The embodiment is not limited to the modes described above.

For example, the categorization between the first ink and the second ink relating to the inks of the plurality of colors discharged by the print head 18 need not necessarily be as described above.

The Y ink has a higher brightness than the CMK inks. Also, depending on the performance and specifications of the scanner used for reading the TP, such as when the reading unit 19 is a monochrome scanner, there is a risk that, in the TP of the Y ink printed using the same number of dots as each of the TPs of the CMK inks, the density may be insufficient as a reading result for the inspection at step S300. Thus, for example, in the embodiment, the CMK inks may be treated as the first ink and the YLCLM inks may be treated as the second ink. In the case of this example, in the color-specific dot count table 50, the number of passes and the thinning ratio of the Y ink may be prescribed to be the same values as the values of the LCLM inks instead of the same values as the CMK inks.

Further, depending on the specification of the printing apparatus 10, the printing apparatus 10 may not be able to use the LC ink and the LM ink, and may use only the CMYK inks. In such a case, in the embodiment, the CMK inks may be treated as the first ink and the Y ink may be treated as the second ink.

The printing apparatus 10 need not necessarily be a so-called serial inkjet printer in which the printing head 18 is mounted on the carriage 17 that moves in the main scanning direction D1, as described above.

A so-called line type inkjet printer for discharging the ink may be assumed, using the printing head 18 including the nozzle rows 26 for each of the ink colors, where the nozzle rows 26 extend in the main scanning direction D1 intersecting the transport direction D2 and are long enough to cover the width of the printing medium 30. In the line type inkjet printer, the nozzle row direction D3 may be understood to be parallel with the main scanning direction D1 rather than with the transport direction D2.

When describing the embodiment assuming that the printing apparatus 10 is the line type inkjet printer, the TP 41 illustrated in FIG. 5 is printed on the printing medium 30 such that each of the pattern elements, which is the ruled line, is parallel with the transport direction D2 rather than with the main scanning direction D1. Further, the plurality of passes of the printing head 18 described above are achieved using back feed by the transport unit 16. The back feed is processing in which the transport unit 16 transports the printing medium 30 from downstream to upstream. In other words, when the printing medium 30 passes under the printing head 18 in the process of transporting the printing medium 30 from upstream to downstream, printing is performed once on the printing medium 30. Thereafter, the transport unit 16 returns the portion of the printing medium 30 that has once been printed, back to a position upstream of the printing head 18, and once more starts transporting the printing medium 30 downstream. By repeating this, the TP 41 can be repeatedly printed in the same manner as the serial inkjet printer prints the TP 41 in the superimposed manner by the plurality of passes.

When the printing apparatus 10 is the line type inkjet printer, the transport of the printing medium 30 by the transport unit 16 during the printing period by the printing head 18 corresponds to the relative movement between the printing head 18 and the printing medium 30. In other words, when the printing apparatus 10 is the line type inkjet printer, the transport velocity of the transport unit 16 during the printing period by the printing head 18 is the same when printing the TP and when performing the normal printing.

It goes without saying that the printing medium 30 need not necessarily be the continuous sheet wound into the roll, as exemplified in FIG. 2, or the like. The printing medium 30 may be a single sheet cut into page units, or the like.

What is claimed is:

1. A printing apparatus comprising;

a printing head including a plurality of first nozzles configured to discharge a first ink and a plurality of second nozzles configured to discharge a second ink having a higher brightness than the first ink; and a control unit configured to control the printing head to print, on a printing medium, a test pattern for inspecting a state of ink discharge by the first nozzles and the second nozzles, wherein the test pattern includes a plurality of first pattern elements formed by a plurality of dots of the first ink using the first nozzles and a plurality of second pattern elements formed by a plurality of dots of the second ink using the second nozzles, the control unit causes the printing head to print the test pattern by printing the second pattern elements with a plurality of scans of the printing head relative to the printing medium along a first direction, where a number of the dots of the second ink forming the second pattern elements is greater than a number of the dots of the first ink forming the first pattern elements, the first pattern elements and the second pattern elements includes line segments, respectively, that extend along the first direction, a pair of the line segments of the first pattern elements that are formed by an adjacent pair of the first nozzles are diagonally adjacent to each other such that the pair of the line segments of the first pattern elements do not overlap with each other as viewed in the first direction and in a second direction perpendicular to the first direction, a pair of the line segments of the second pattern elements that are formed by an adjacent pair of the second nozzles are diagonally adjacent to each other such that the pair of the line segments of the second pattern elements does not overlap with each other as viewed in the first direction and in the second direction, and the pair of the line segments of the first pattern elements are aligned with the pair of the line segments of the second pattern elements, respectively, as viewed in the first direction.

2. The printing apparatus according to claim 1, wherein the printing head is configured to perform one or more scans to discharge the first ink from the first nozzles in accordance movement along the first direction and perform the plurality of scans to discharge the second ink from the second nozzles in accordance with movement along the first direction, and the control unit causes the printing head to print the test pattern where a number of the plurality of scans for printing the second pattern elements is greater than a number of the one or more scans for printing the first pattern elements.

3. The printing apparatus according to claim 1, wherein the control unit causes the printing head to print the test pattern where a discharge rate of the second ink by the second nozzles for printing the second pattern elements is higher than a discharge rate of the first ink by the first nozzles for printing the first pattern elements.

4. The printing apparatus according to claim 1, wherein when printing the test pattern by a relative movement between the printing head and the printing medium, the control unit causes a velocity of the relative movement to be the same as a velocity of the relative movement when performing normal printing.

5. The printing apparatus according to claim 1, wherein the control unit causes a waveform of a drive signal used to drive the first nozzles and the second nozzles when printing the test pattern to be the same as a waveform of a drive signal used to drive the first nozzles and the second nozzles when performing normal printing.

6. A printing method comprising:

a printing step of printing a test pattern on a printing medium, using a printing head including a plurality of first nozzles configured to discharge a first ink and a plurality of second nozzles configured to discharge a second ink having a higher brightness than the first ink, the test pattern being used to inspect a state of ink discharge by the first nozzles and the second nozzles, wherein the test pattern includes a plurality of first pattern elements formed by a plurality of dots of the first ink using the first nozzles and a plurality of second pattern elements formed by a plurality of dots of the second ink using the second nozzles, the printing step causes the printing head to print the test pattern by printing the second pattern elements with a plurality of scans of the printing head relative to the printing medium along a first direction, where a number of the dots of the second ink forming the second pattern elements is greater than a number of the dots of the first ink forming the first pattern elements, the first pattern elements and the second pattern elements includes line segments, respectively, that extend along the first direction, a pair of the line segments of the first pattern elements that are formed by an adjacent pair of the first nozzles are diagonally adjacent to each other such that the pair of the line segments of the first pattern elements do not overlap with each other as viewed in the first direction and in a second direction perpendicular to the first direction, a pair of the line segments of the second pattern elements that are formed by an adjacent pair of the second nozzles are diagonally adjacent to each other such that the pair of the line segments of the second pattern elements does not overlap with each other as viewed in the first direction and in the second direction, and the pair of the line segments of the first pattern elements are aligned with the pair of the line segments of the second pattern elements, respectively, as viewed in the first direction.

* * * * *